US006681873B2

(12) United States Patent
Griffin, Jr.

(10) Patent No.: US 6,681,873 B2
(45) Date of Patent: Jan. 27, 2004

(54) CORE STABILIZATION APPARATUS AND METHOD THEREFOR

(75) Inventor: Theodore Joseph Griffin, Jr., Spring, TX (US)

(73) Assignee: Core Laboratories Global N.V., Amsterdam (NL)

( * ) Notice: Subject to any disclaimer, the term of this patent is extended or adjusted under 35 U.S.C. 154(b) by 0 days.

(21) Appl. No.: 10/176,593

(22) Filed: Jun. 21, 2002

(65) Prior Publication Data

US 2002/0162688 A1 Nov. 7, 2002

Related U.S. Application Data

(63) Continuation of application No. 09/501,926, filed on Feb. 10, 2000, now Pat. No. 6,443,243.
(60) Provisional application No. 60/125,404, filed on Mar. 20, 1999.

(51) Int. Cl.[7] ..... E21B 25/02
(52) U.S. Cl. ..... 175/58; 175/4; 175/249
(58) Field of Search ..... 175/17, 59, 226, 175/58, 4, 249, 207, 239, 240, 218

(56) References Cited

U.S. PATENT DOCUMENTS

| | | | | | |
|---|---|---|---|---|---|
| 4,071,099 | A | * | 1/1978 | Hensel, Jr. | 175/59 |
| 4,371,045 | A | * | 2/1983 | McGuire et al. | 175/17 |
| 4,587,857 | A | * | 5/1986 | Bush | 73/863 |
| 4,825,963 | A | * | 5/1989 | Ruhle | 175/60 |
| 6,006,844 | A | * | 12/1999 | Van Puymbroeck et al. | 175/50 |

* cited by examiner

*Primary Examiner*—Frank Tsay
(74) *Attorney, Agent, or Firm*—Barry S. Newberger; Winstead Sechrest & Minick P.C.

(57) ABSTRACT

A core stabilization apparatus and method are implemented. An inner barrel having a plurality of ports disposed circumferentially and axially in a wall thereof is provided. A gas manifold is attached to a first subsets of the ports. Gas is delivered to an interior of the inner barrel via the gas manifold and the corresponding ports. Drilling mud remaining in the interior of the inner barrel is expelled through a second subset of ports. After expulsion of the drilling mud, a stabilizing compound is injected into the interior via an injection manifold attached to the second subset of ports. Upon curing of the stabilizing compound, the inner barrel and core sample contained therein may be sectioned or otherwise manipulated.

16 Claims, 8 Drawing Sheets

400

CORE STABILIZATION APPARATUS AND METHOD THEREFOR

CROSS-REFERENCE TO RELATED APPLICATION

This application is a continuation of U.S. application Ser. No. 09/501,926 filed Feb. 10, 2000 which is now U.S. Pat No. 6,443,243.

The present application is related to U.S. Provisional Patent Application Ser. No. 60/125,404 , filed Mar. 20, 1999 entitled "CORE STABILIZATION APPARATUS AND METHOD THEREFOR," which is hereby incorporated herein by reference.

TECHNICAL FIELD

The present invention relates in general to the drilling of core samples, and in particular to the stabilization of the recovered core in a core barrel.

BACKGROUND INFORMATION

Cores (drilling core samples) acquired in the subsurface of the earth are generally recovered with a core barrel that either has a disposable inner barrel or a disposable inner barrel liner. (For the purposes of the present invention, the distinction is not material, and "inner barrel," will be used to refer to both a disposable inner barrel and a disposable inner barrel liner.) At the surface, the core barrel is separated from the coring assembly and placed on the drilling rig floor or other work area.

If the core material is unconsolidated, the core is "stabilized" to prevent mechanical damage caused by handling and shipment. Core stabilization may either be by freezing with dry ice to artificially consolidate the core, or by filling an annular space of the core barrel with a non-reactive core stabilizing compound, for example, epoxy or gypsum. FIG. 1 illustrates, in transverse cross section, an inner barrel 102, enclosing a core sample 104. Because core sample 104 does not completely fill inner barrel 102, a void space 106 remains in an interior of inner barrel 102, which may be filled to prevent core sample 104 from moving within inner barrel 102, to prevent damage to the core by handling and shipment of the samples. In both the epoxy fill or gypsum fill techniques, the inner barrel, which may be thirty feet or more in length, is first sectioned into approximately one meter segments. Each segment is placed on a rack in a near horizontal position to drain any drilling fluid, or mud, from the inner barrel. The base of the segment is then stabilized. After the base is stabilized, the segment is placed in a near vertical position and the entire segment stabilized. Thus, the present methodologies entail substantial handling of the inner barrel and enclosed core sample, and the sample is thus susceptible to mechanical damage caused by vibration, jarring, or other movement.

Thus, there is a need in the art for apparatus and methods that reduce the risk of core damage and the stabilization of core samples in inner barrels. In particular, there is a need in the art for techniques that reduce the movement and handling of the inner barrel, and the contained core in the stabilization process, and, which advantageously permits stabilization of the full length of the inner barrel without the need for segmenting the inner barrel and contained core sample.

SUMMARY OF THE INVENTION

The present invention provides a core stabilization mechanism which stabilizes the core along the entire length of the inner barrel. At each one of a plurality of positions spaced axially along the inner barrel, a set of ports are provided. The ports are displaced circumferentially about the inner barrel at each axial location. One port of the set provides a vent port, and the others provide drainage and injection ports. During the stabilization process, air, or other gas, is injected into the vent port, via a gas manifold attached thereto, thereby effectuating the drainage of the drilling mud from the drainage/injection ports. After the drilling mud has been drained, a core stabilizing compound is simultaneously injected into all of the drainage/injection ports, at each position along the length of the inner barrel. An injection manifold is attached to a drain/inlet coupled to each drainage/injection port. The injection manifold is fed from a stabilizing compound supply. The core stabilizing compound is then allowed to cure. After curing, the inner barrel, with the stabilized core contained therein may be sectioned into segments for ease in handling and transport.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
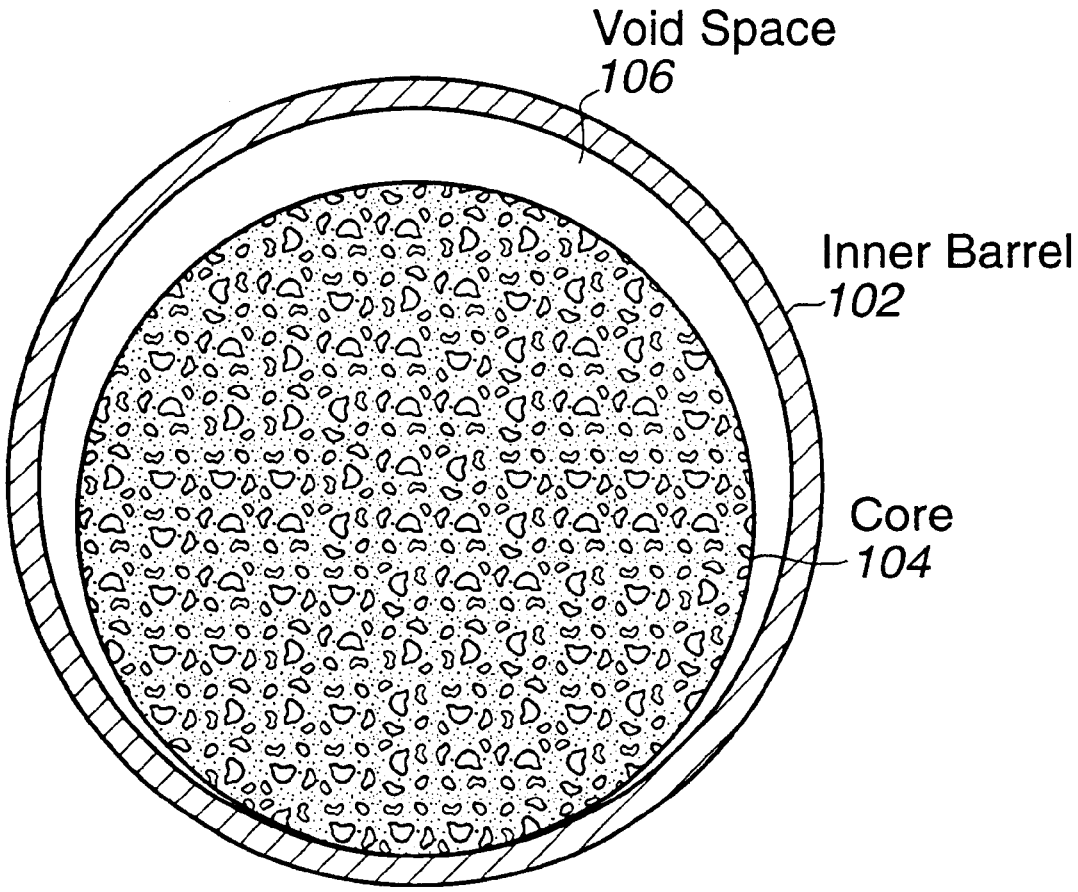
FIG. 1 illustrates a transverse cross-sectional view of an inner barrel.

In the following description, numerous specific details are set forth, such as, specific pressures, flow rates, angles, etc., to provide a thorough understanding of the present invention. However, it will be obvious to those skilled in the art that the present invention may be practiced without such specific details.

Refer now to the drawings wherein depicted elements are not necessarily shown to scale and wherein like or similar elements are designated by the same reference numeral through the several views.

Figure 2:
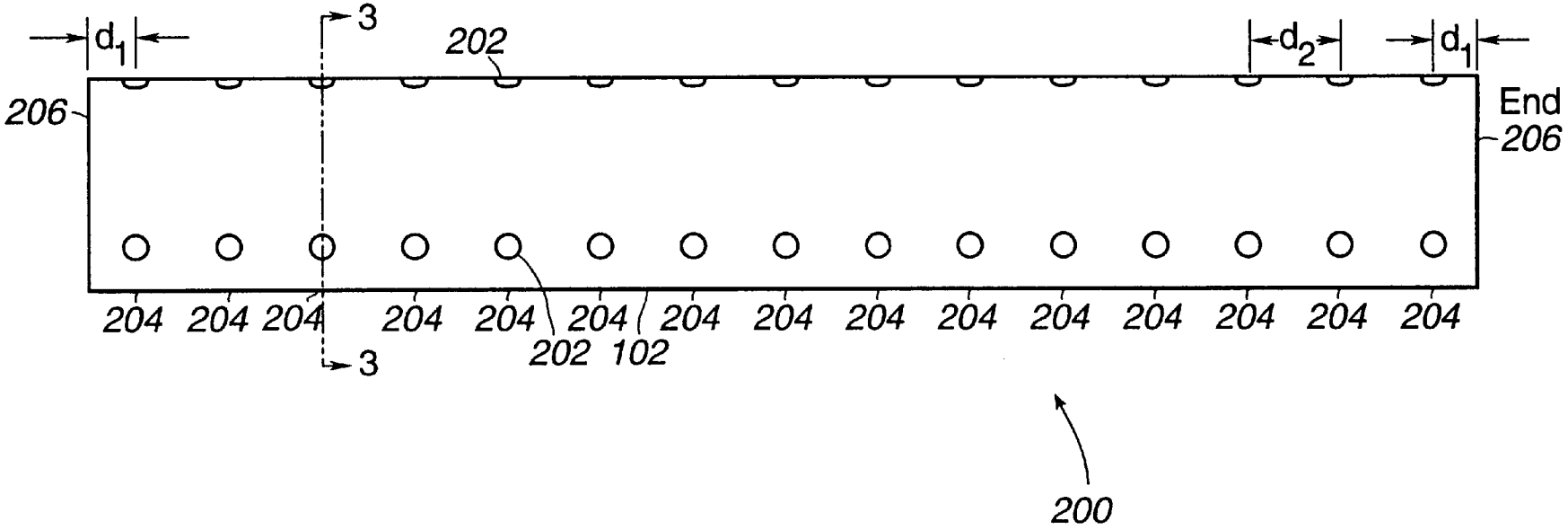
FIG. 2 illustrates, in a longitudinal elevation view, an inner barrel in accordance with an embodiment of the present invention.
Figure 3:
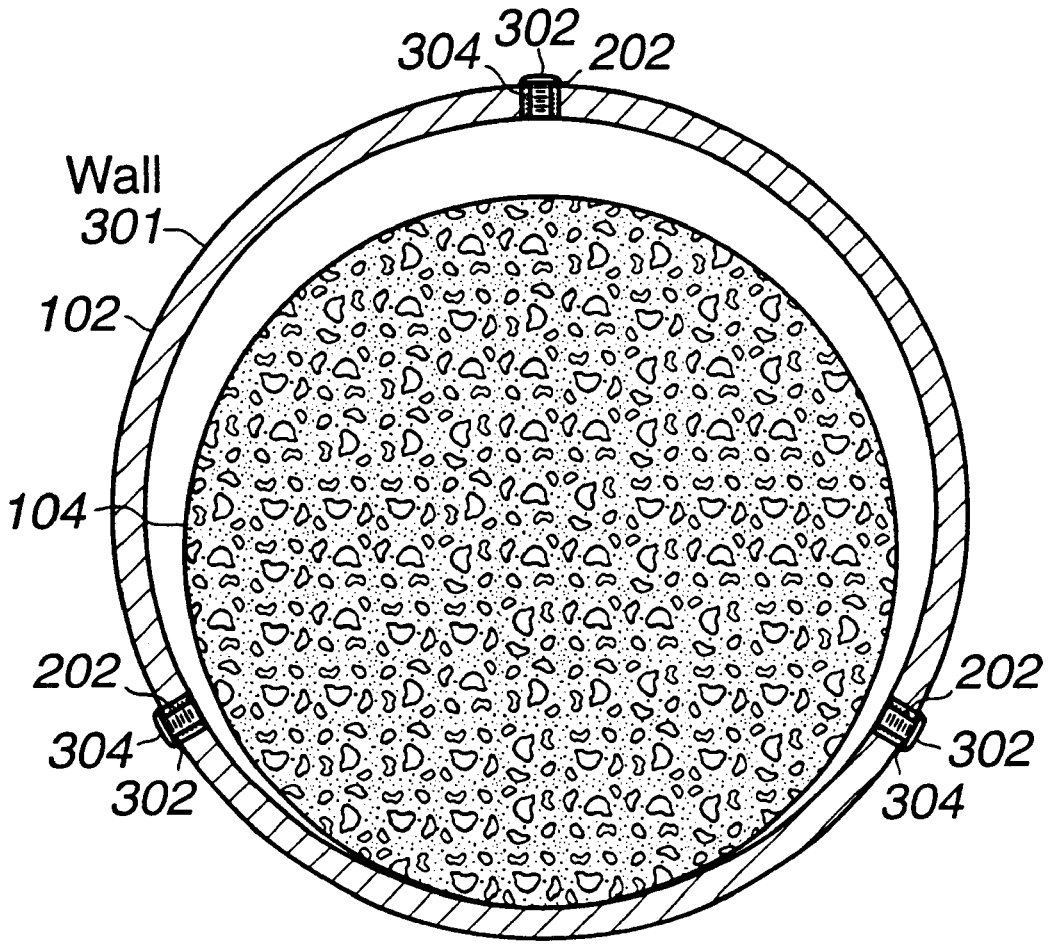
FIG. 3 illustrates a cross-sectional view of a core sample and inner barrel in accordance with an embodiment of the present invention.

Referring now to FIG. 2 illustrating a longitudinal elevation view of inner barrel 102 in accordance with the principals of the present invention. A plurality of ports 202 is provided in inner barrel 102. Ports 202 are disposed circumferentially about inner barrel 102 at a plurality of locations 204. A set of ports 202, which are hidden from view in FIG. 2, may also be provided in inner barrel 102, as shown in FIG. 3, described below. Locations 204 may be disposed axially along a length of inner barrel 102. A first pair of locations 204 may be a distance $d_1$ from ends 206 of inner barrel 102. Locations 204 may be spaced a distance $d_2$ from each other. In an embodiment of the present invention $d_1$ may be one inch (1.0") and $d_2$ may be two inches (2.0"), however, alternative embodiments having other values for distances $d_1$ and $d_2$ would be within the spirit and scope of the present invention. Spacing locations 204 closely, increases cost and complexity of the apparatus of the present invention, but the locations must be sufficiently close to permit the stabilizing compound to fill void space 106 without having axial gaps along the length of inner barrel 102.

Each of ports 202 is adaptable for receiving a plug during extraction of the core sample, and further adaptable for receiving a fitting for the attachment of one or more manifolds for the delivery of a displacing gas, and the delivery of a core stabilizing compound.

Refer now to FIG. 3 illustrating a cross section of an inner barrel 102 and enclosed core sample 104 in accordance with the present invention. The cross section is substantially at one of locations 204, as indicated in FIG. 2 Ports 202 disposed circumferentially about inner barrel 102, and which penetrate wall 301, are indicated. Additionally, plugs 302 are shown inserted in each of ports 202. Plugs 302 are inserted in ports 202 during extraction of the core sample, and are removable. Each of ports 202, in FIG. 3, are illustrated as having a thread 304, with a corresponding thread on each of plugs 302 for mating with threads 304. Although the embodiment of ports 202 in FIG. 3 are threaded, it would be understood by an artisan of ordinary skill in the fastener art that alternative embodiments having other fastening mechanisms, for example, a bayonet structure, would be within the spirit and scope of the present invention. A fastening mechanism need only be sufficient to retain plugs 302 within ports 202 during extraction of the core sample, and sufficient to retain the manifold attachment fittings during the stabilization process, as described further below, in conjunction with the FIGS. 4–8.

Figure 4:
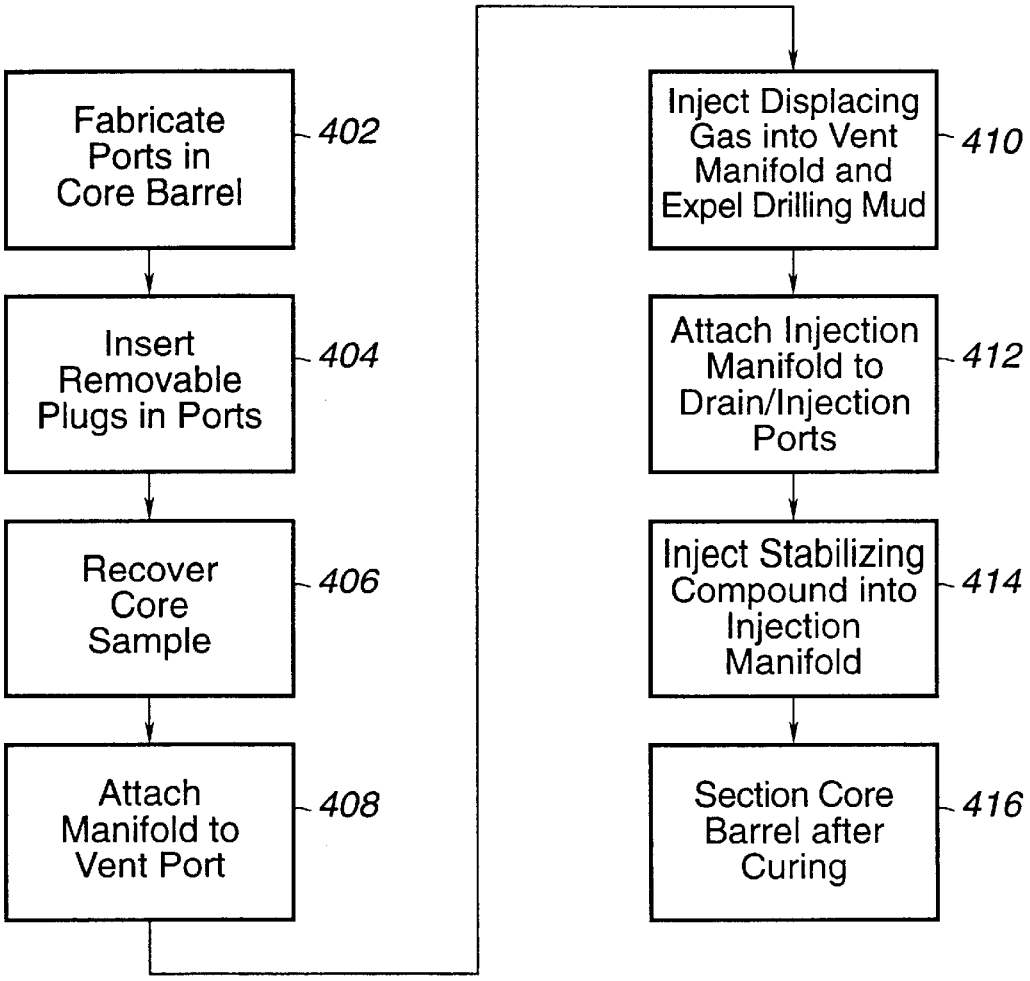
FIG. 4 illustrates, in flowchart form, a core stabilization methodology in accordance with an embodiment of the present invention.

Referring now to FIG. 4, there is illustrated, in flowchart form, core stabilization methodology 400 in accordance with the present invention. In step 402, ports are fabricated in the inner barrel. The ports, such as ports 202 in FIG. 2, are disposed about the circumference of the inner barrel, for example, inner barrel 102, and sets of circumferentially disposed ports are placed at a plurality of locations 204 along the length of the inner barrel, as illustrated in FIG. 2. In step 404, removable plugs, for example, plugs 302 in FIG. 3, are inserted in each of the ports. In step 406, a core sample is recovered in accordance with methodologies known in the core drilling art.

Figure 5:
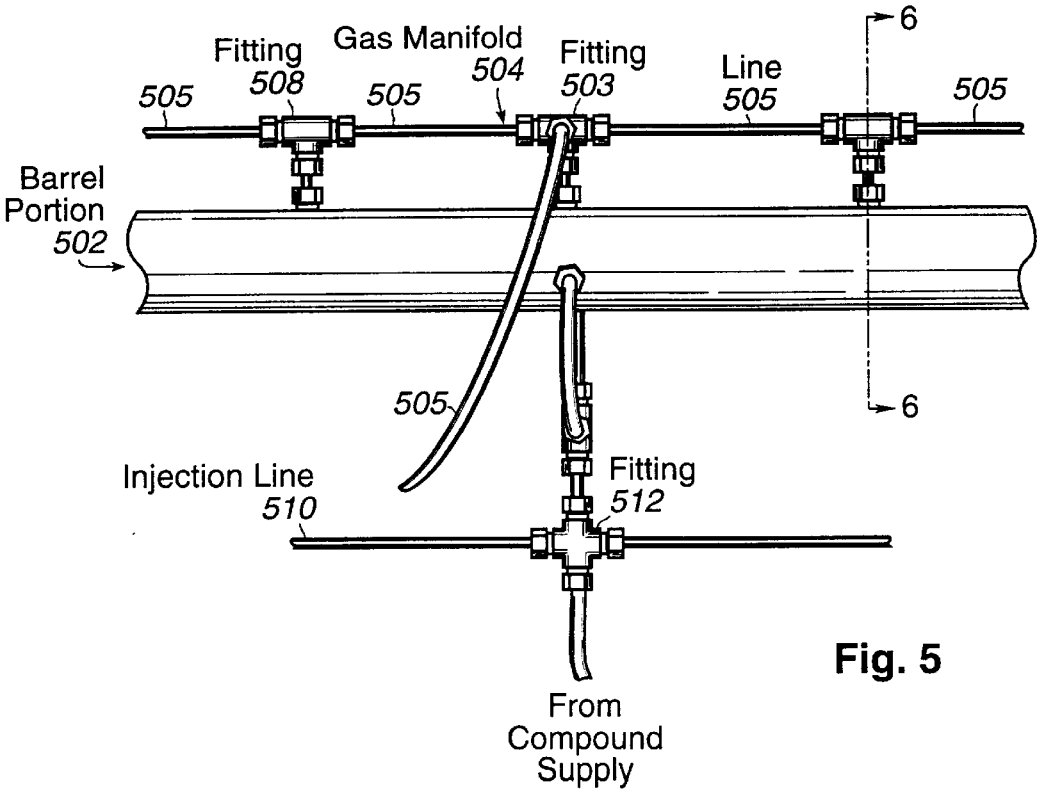
FIG. 5 illustrates, in a longitudinal elevation view, a portion of an inner barrel in accordance with another embodiment of the present invention.

Following recovery, a gas delivery manifold is attached to a plurality of vent ports 501 on a top portion of the inner barrel. Vent ports 501 constitute a subset of ports 202. This may be further understood by referring now to FIG. 5 illustrating a portion 502 of an inner barrel in accordance with the present invention. Gas manifold 504, which includes a plurality of fittings 503 and gas lines 505, is attached to a plurality of ports 501 (obscured in FIG. 5 by fittings 508) disposed along a top portion 506 of inner barrel portion 502. Gas manifold 504 attaches to fittings 508, that are adapted for insertion into the plurality of ports 501 disposed along the top portion 506 of inner barrel portion 502. In an embodiment of the present invention in which the ports are threaded, such as, ports 202 in FIG. 3, having threads 304, it would be understood by an artisan of ordinary skill that fittings 506 would have threads which match threads 304 in the ports 501.

Figure 6:
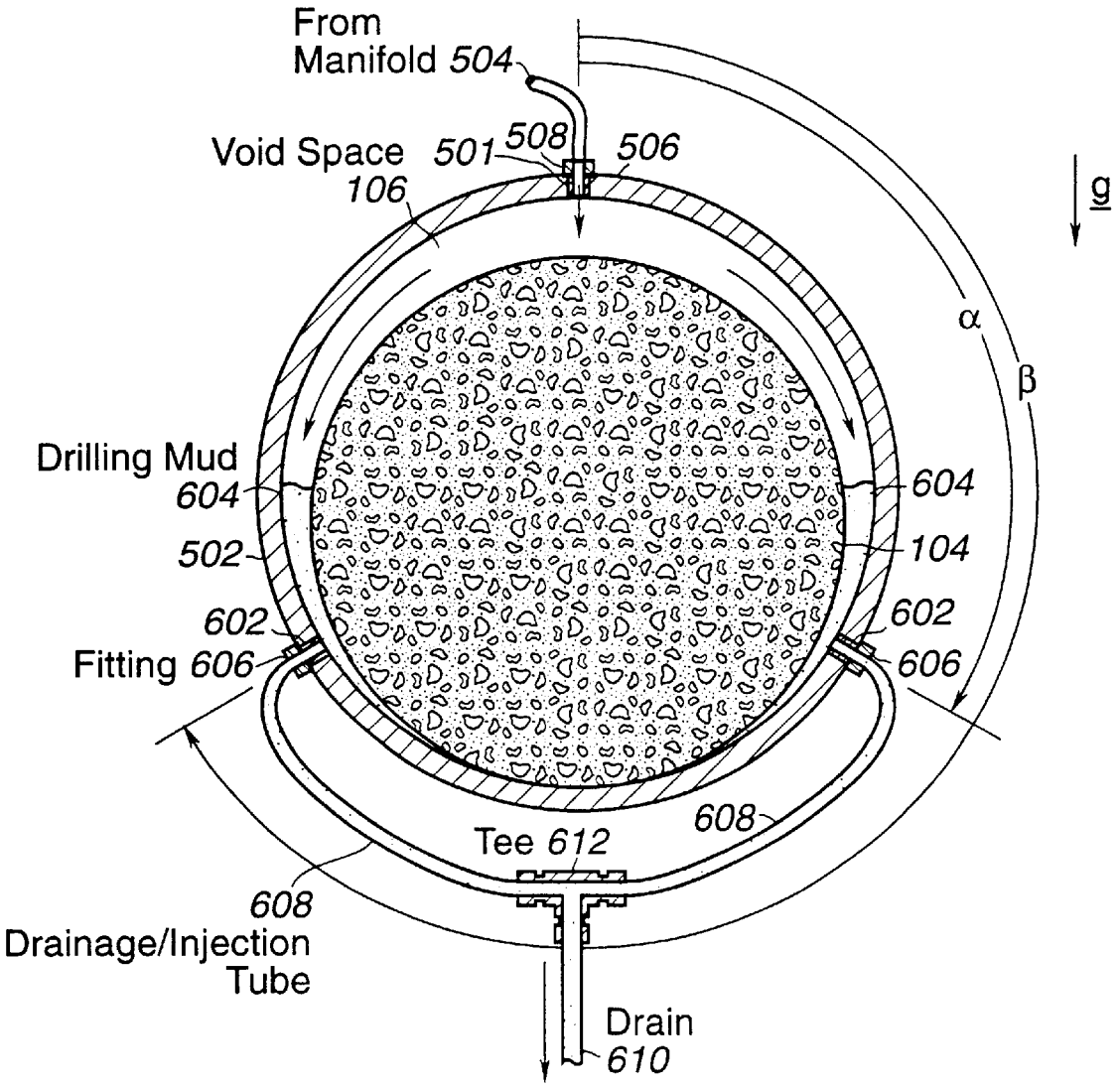
FIG. 6 illustrates a cross-sectional view of an inner barrel with an enclosed core sample in accordance with the embodiment of the present invention of FIG. 5.

Returning now to FIG. 4, in step 410, displacing gas is injected into the gas manifold, such as, gas manifold 504 in FIG. 5, and drilling mud remaining within the inner barrel is expelled. This may be further understood by referring now to FIG. 6 showing a cross section of inner barrel portion 502 at a position substantially as shown in FIG. 5. Gas, injected into manifold 504 pressurizes void space 106 in inner barrel portion 502. Drilling mud 604 remaining in portion 502 is thereby displaced in the direction of drain/injection ports 602. Drain/injection ports 602 constitute a subset of ports 202 Drain/injection ports 602 may be displaced by angles $\alpha$ and $\beta$, respectively, along the circumference of inner barrel portion 502, relative to vent port 501. In an embodiment of the of the present invention $\alpha$ may be 135° and $\beta$ may be 225°, however, it would be understood alternative embodiments having other values for $\alpha$ and $\beta$ would be within the spirit and scope of the present invention.

Drilling mud 604 is expelled through ports 602 via fittings 606 inserted within ports 602 The drilling mud is transported through drainage/injection tubes 608 coupled to fittings 606 which are joined to drain/inlet 610 by tee 612. In an embodiment of the present invention drainage/injection tubes 608 may have a diameter of one-quarter inch (0.25"), but it would be understood by an artisan of ordinary skill that alternative embodiments having other diameters would be within the spirit and scope of the present invention. The drilling mud is then expelled through drain/inlet 610.

In an embodiment of the present invention, the displacing gas may be compressed air, however, an artisan of ordinary skill would understand that other gases, for example, nitrogen or carbon dioxide, may also be used in alternative embodiments, and would be within the spirit and scope of the present invention. The gas pressure need only be sufficient to displace drilling mud 604 into ports 602. Moreover, the pressures of the displacing gas may be maintained to a sufficiently low value such that the rate at which drilling mud 604 flows into ports 602 is sufficiently slow to avoid damage or disruption to core sample 104 by the motion of mud 604 With the orientation of inner barrel portion 504 as shown in FIG. 6, relative to the acceleration of gravity, g, gravity segregation assists the displacement of the drilling mud 604. In such an embodiment, displacing gas pressures of the order of one to two pounds per square inch gauge (psig) may be used.

Figure 7:
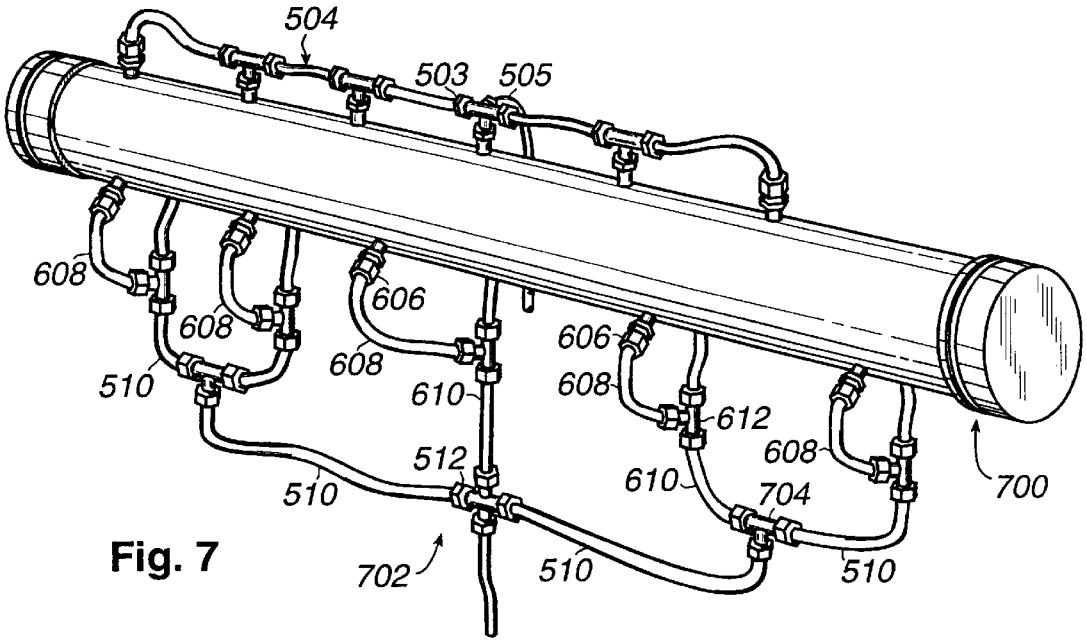
FIG. 7 illustrates another portion of the inner barrel in accordance with the embodiment of FIG. 5.

Returning to FIG. 4, in step 412, an injection manifold is attached to the drain/injection ports 602 via drain/inlet 610. This may be understood by referring to FIG. 5 showing injection line 510, part of the injection manifold, coupled to fitting 512, which is also part of the injection manifold. A core stabilizing compound supply is coupled to the injection manifold via fitting 512. The attachment of the injection manifold may be further understood by referring now to FIG. 7, illustrating stabilization apparatus 700 in accordance with the present invention. Injection manifold 702 includes a plurality of injection lines 510 joined by fittings 704. Each fitting 704 additionally coupled to the corresponding one of drain/inlets 610.

Figure 8:
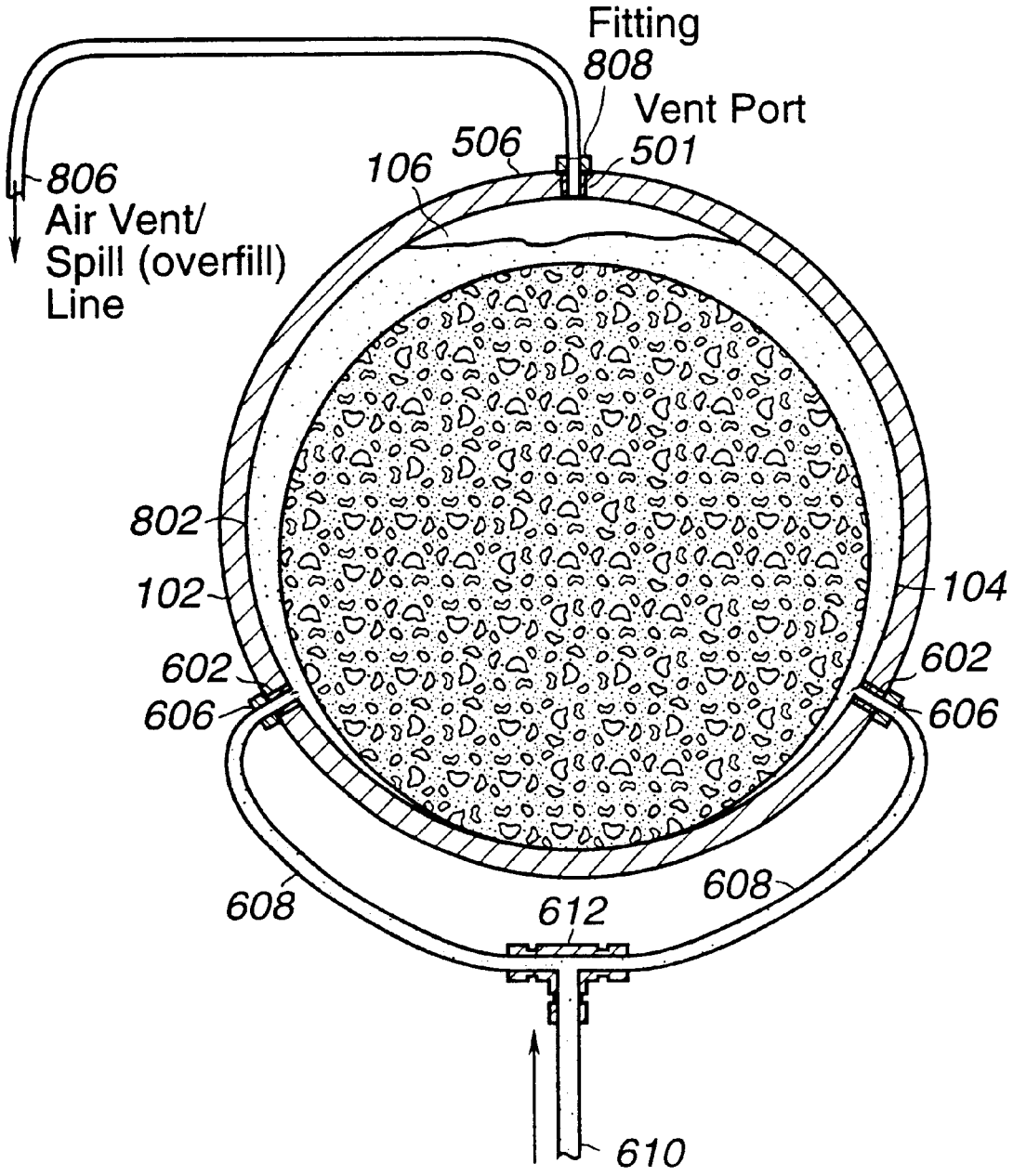
FIG. 8 illustrates in cross-sectional view an inner barrel with an enclosed core sample in accordance with yet another embodiment of the present invention.

Referring again to FIG. 4, in step 414 of stabilization methodology 400, core stabilizing compound is injected into the injection manifold, where it inflows via drain/inlet 610, as shown in FIG. 8, through tee 612 into drainage/injection tubes 608 and then through ports 602. Compound 802 then flows into void space 106 and fills the space.

As compound 802 fills void space 106, any air, or other gas, within void space 106 is displaced. The gas is vented through vent port 501. The gas is discharged through vent/spill line 806, which is coupled to vent port 501 via fitting 808. Fitting 808 is adapted for insertion into vent port 804, and in an embodiment of the present invention in which vent port 804 is threaded, includes a thread matching the thread 304 of vent port 804. However, it would be understood by an artisan of ordinary skill in the art that other fastening methods may be used to attach fitting 808 to vent port 804, as described hereinabove, and such methods would be within the spirit and scope of the present invention. Additionally, vent/spill line 806 allows for the escape of excess compound 802, once void space 602 is completely filled. In this way, excess compound 802 is allowed to escape, without incurring stresses within inner liner 102 which might otherwise disrupt core sample 104.

The flow rates of compound 802 should be sufficient to fill void space 106 within a working time of the epoxy mixture. However, flow rates must be sufficiently slow that the flow rate of compound 802 within void space 106 will not generate stresses in core sample 104 that might disturb or disrupt the sample. In an embodiment of the present invention in which the stabilizing compound is epoxy, a flow rate of 0.8 gallons per minute may be used, however, other flow rates that otherwise satisfy the aforementioned requirements may be used and would be within the spirit and scope of the present invention.

Figure 9:
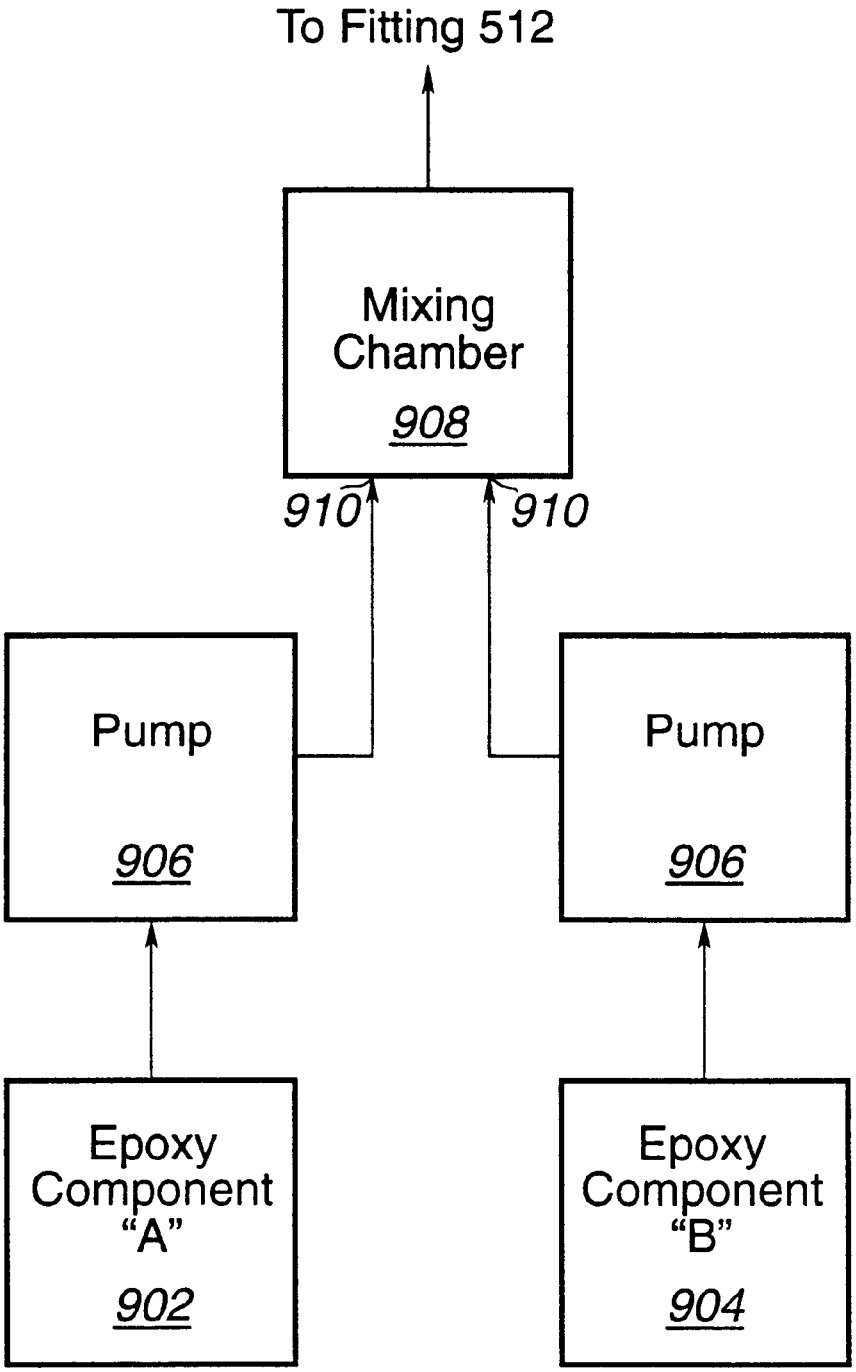
Fig. 9 (Prior Art)
FIG. 9 illustrates, in block diagram form, a conventional epoxy supply which may be used with the present invention.

In an embodiment in which compound 802 is epoxy, the epoxy may be provided to injection manifold 702 using conventional apparatus. Such an apparatus is illustrated in FIG. 9. The epoxy is formed from two components, herein labeled component A, and component B, as is well known in the art. Component A and component B are provided in reservoirs 902 and 904, respectively. Each of the components is pumped from the respective reservoir by one of pumps 906 into mixing chamber 908. From mixing chamber 908, the epoxy mixture is delivered to injection manifold 702 via fitting 512, as previously described. Pumps 906 and 908 deliver components A and B into mixing chamber 908 at a pressure sufficient to deliver epoxy mixture 802 within the flow rates previously discussed. In an embodiment of the present invention having a flow rate of 0.8 gallons per minute, a pressure of approximately twelve to fifteen psig may be provided by pumps 906 at their respective inputs 910 to mixing chamber 908.

Referring again to FIG. 4, after injection step 414, upon curing of the epoxy, core sample 104 is stabilized within inner barrel 102. Inner barrel 102 and core sample 104 within may be freely handled without risk of damage to core sample 104. Thus, in step 416, for example, the inner barrel and core sample may be sectioned for ease in transport or other handling.

In this way, a core stabilization apparatus and method are provided. A core sample within an inner barrel may be stabilized using an epoxy mixture without first sectioning inner barrel and enclosed core sample. The core sample is stabilized along the entire length of the inner barrel by simultaneously injecting epoxy into the barrel through a plurality of ports provided in the inner barrel. Delivery of the epoxy mixture to the injection ports is provided through an injection manifold. Before injecting the epoxy mixture, drilling mud remaining within the inner barrel is expelled using a displacing gas introduced into a plurality of vent ports provided in the inner barrel. The vent ports also permit the displacement of gas within the inner barrel void space during injection of the core stabilizing compound, and, additionally, allow for the escape of any excess epoxy supplied during the injection process.

What is claimed is:

1. A core stabilization method comprising injecting a noncryogenic stabilizing compound into a core-containing structure through a plurality of ports in the core-containing structure, wherein the plurality of ports is disposed axially along the core-containing structure.

2. The method of claim 1 wherein the plurality of ports includes a first subset of the plurality of ports and a second subset of the plurality of ports, the first and second subsets being axially disposed along the core-containing apparatus, and wherein the noncryogenic stabilizing compound is injected through the first subset of the ports, and further comprising expelling fluid from an interior volume of the core-containing structure through the second subset of ports.

3. The method of claim 1 further comprising delivering a displacing gas through at least a subset of the plurality of ports.

4. The method of claim 3, the at least a subset of the plurality of ports comprising a first subset of the plurality of ports axially disposed along the core-containing structure, and wherein the plurality of ports further includes a second subset of the plurality of ports axially disposed along the core-containing structure, the noncryogenic stabilizing compound being injected through the second subset of the plurality of ports, and wherein the second subset of the plurality of ports is displaced circumferentially relative to the first subset of the plurality of ports.

5. The method of claim 1 wherein the core-containing structure is adapted for stabilizing an unsleeved core.

6. The method of claim 1 wherein the stabilizing compound is selected from the group consisting of gypsum and epoxy.

7. The method of claim 1 wherein a flow rate of the stabilizing compound is less than a flow-rate value sufficient to disrupt a core sample in the core-containing structure.

8. A core-stabilizing apparatus comprising a core-containing structure having a plurality of ports adapted for injecting a noncryogenic core-stabilizing compound into the core-containing structure, wherein the plurality of ports is disposed axially along the core-containing structure.

9. The apparatus of claim 8 wherein the plurality of ports includes a first subset of the plurality of ports axially disposed along the core-containing structure and a second subset of the plurality of ports, and wherein first subset of ports is adapted for injecting the noncryogenic core-stabilizing compound the second subset adapted for injecting a displacing gas into the core-containing structure, the second subset of the plurality of ports being axially disposed along the core-containing structure.

10. The apparatus of claim 9 further comprising a third subset of the plurality of ports adapted for expelling fluid from the core-containing structure, the third subset of the plurality of ports axially disposed along the core-containing structure.

11. The apparatus of claim 10 wherein the first subset of the plurality of ports and the third subset of the plurality of ports are the same.

12. The apparatus of claim 9 wherein the each of the second subset of ports is adapted for fastenably receiving a fitting adapted for the delivery of the displacing gas.

13. The apparatus of claim 9, wherein the second subset of the plurality of ports is displaced circumferentially relative to the first subset of the plurality of ports.

14. The apparatus of claim 8 wherein at least a subset of ports is adapted for fastenably receiving a fitting adapted for the delivery of the noncryogenic core-stabilizing compound.

15. The apparatus of claim 8 wherein the core-containing structure is selected from the group consisting of an inner barrel and an inner barrel liner.

16. A stabilized core product comprising:

a core sample recovered from beneath the surface of the Earth;

a core-containing structure having a plurality of ports axially disposed thereon and an interior space, wherein the core sample is disposed within a first portion of the interior space of the core-containing structure; and a core-stabilizing compound disposed within a second portion of the interior space, the second portion being between the core sample and a bounding surface of the interior space of the core-containing structure, wherein the core-stabilizing compound is injected into the second portion through the plurality of ports.

* * * * *